US005791650A

United States Patent [19]

Pardee

[11] Patent Number: 5,791,650

[45] Date of Patent: Aug. 11, 1998

[54] BOARD GAME

[76] Inventor: Scott D. Pardee, 150 Etna Rd., Ithaca, N.Y. 14850

[21] Appl. No.: 629,586

[22] Filed: Apr. 9, 1996

[51] Int. Cl.[6] ..... A63F 3/00

[52] U.S. Cl. ..... 273/248; 273/260; 273/291

[58] Field of Search ..... 273/260, 261, 273/243, 248, 249, 288, 290, 291

[56] References Cited

U.S. PATENT DOCUMENTS

| | | | |
|---|---|---|---|
| 3,709,498 | 1/1973 | Liston | 273/260 |
| 3,794,326 | 2/1974 | Bialek | 273/260 |
| 3,989,353 | 11/1976 | Schifman | 273/260 |
| 4,194,741 | 3/1980 | Rea | 273/260 X |
| 4,391,449 | 7/1983 | Johnson | 273/260 |
| 4,506,893 | 3/1985 | Perry | 273/260 X |
| 4,902,021 | 2/1990 | Burroughs | 273/260 |
| 5,018,744 | 5/1991 | Patracuolia | 273/248 |
| 5,080,370 | 1/1992 | Lu | 273/260 |
| 5,318,305 | 6/1994 | LoCoco | 273/258 |
| 5,456,472 | 10/1995 | Goodman | 273/260 X |
| 5,536,014 | 7/1996 | Serfozo | 273/260 |

FOREIGN PATENT DOCUMENTS

| | | | |
|---|---|---|---|
| 2085737 | 5/1982 | United Kingdom | 273/260 |

*Primary Examiner*—William E. Stoll
*Attorney, Agent, or Firm*—Brown, Pinnisi & Michaels

[57] ABSTRACT

A novel board game utilizing a two-dimensional board having spaces arranged in orthogonal rows and columns in two alternating contrasting colors. Two dice are used as a chance element. Each player is assigned 12 ordinary pieces in one of the colors and a "king" piece. The "king" piece is bi-colored, so that when attacked or captured it may be converted to the other color by inverting it. The "King" counts as two pieces for the purposes of attack and stacking, and can move forward or backward. A path of play begins in a corner space of the player's color termed the "Start" and proceeds in a defined path from space to intersection to space alternately across the board to another corner space termed the "Finish". The path of play turns at a right angle at each space, so that the player always exits a space on the same side he entered it, and such a path change may be symbolized by a corner symbol on the board. The path proceeds in this fashion from the "Start" to the "Finish", traversing all of the spaces in the player's color at least once. The turns in the game comprise two phases for each player: jumping and roll/move. The object of the game is to be the first to get all pieces to the "Finish" space. A player may "capture" and send his opponent's pieces back to the "start" space by either landing on the pieces with an equal or superior number of pieces, or by trapping the pieces in a special triangular arrangement of pieces on two intersections and an angle known as a "Chebache". An additional win situation is to trap the opponent's "king" in a "Chebache" from which it cannot escape.

27 Claims, 4 Drawing Sheets

BOARD GAME

FIELD OF THE INVENTION

The invention pertains to the field of board games. More particularly, the invention pertains to checkers-type board games involving strategy and movement.

BACKGROUND OF THE INVENTION

There is a class of board games involving generally rectangular or space boards and a plurality of markers (flat chips or pegs) which are either all identical or perhaps of two kinds (the second usually being termed "Kings"). Such games are generally derived from one of the classical board games such as checkers or backgammon.

In backgammon, one of the oldest board games known, the pieces are moved on the board based upon an element of chance (the dice). The object is to move all of the pieces off the board. The rules are fairly complex, and some versions include betting and rolling a special "doubles" die.

Board games such as checkers ("draughts") and its variants (Chinese checkers, etc.) are familiar to most people. Basic checkers involves moving markers unidirectionally (except for a "King" piece) across a space board, with the intent of capturing or immobilizing all of an opponent's pieces. Except for the ability to move forwards or back, the "King" is usually no different from the other pieces, and begins the game as an ordinary piece. One piece is moved during each turn, and the number of spaces moved is fixed, except during jumping in which case the piece is moved as long as it can jump. There is no chance element (dice or spinner). Except for the direction of travel, the path each piece takes is determined by the player.

There are many lesser known board games using bi-color boards. Many have been patented over the years. Two relatively recent examples are Patracuolia, U.S. Pat. No. 5,018,744 and LoCoco, U.S. Pat. No. 5,318,305.

Like the present invention or backgammon, Patracuolia moves chips on a 9×10 space board based on a dice roll. The markers are moved from a plurality of starting spaces to a plurality of ending spaces and then off the board, and the object is to move all of one's pieces off the board first. Patracuolia uses specially designed dice, including a doubling dice. The markers are moved in a path determined by the player, left, right or forward, with a "King" piece being provided which is the only one which can be moved backward. There is also an intermediate rank piece called a "knight" formed by having a "King" jump over one of the ordinary pieces.

LoCoco uses a 7×8 space board. Three spaces on each side of center are shaded and marked with the numbers 1, 2 and 3. These form the "safety zones" for the players. Each piece has a movement value (1, 2 or 3) which defines how many spaces it may be moved in any direction. The pieces may be stacked, in which case the stack may be moved the sum of the movement factors of the individual pieces. Opposing pieces are "captured" and eliminated by landing one's piece(s) on a space occupied by an opposing piece. The winner is the first to place at least one piece in the player's goal or "safety zone" which has the same number and color as the piece. LoCoco does not use a chance element.

The present invention grew out of frustration with the current strategic board games discussed above, and the desire for a new game that would bridge the gap between backgammon and chess. Backgammon appeared too "light" and based on the luck of the dice, while chess was too "heavy" and difficult to learn. So, the present invention, which I have named "Chebache™", was designed to combine some elements of checkers backgammon and chess (hence the name "Che-ba-che") into a completely new and novel board game. The game can be quickly learned and fun to play, yet requires skill and planning.

SUMMARY OF THE INVENTION

The invention presents a novel board game utilizing a two-dimensional generally rectangular board having squares or spaces arranged in rows and columns in two alternating contrasting colors. Two dice are used as a chance element. Each player is assigned 12 ordinary pieces in one of the colors and, preferably, a "King" piece. The "King" piece is bi-colored, so that it may be converted to the other color by inverting it, and counts as two pieces for the purposes of attack and stacking.

The preferred path of play begins in a corner space termed the "Start" and proceeds in a defined path from the inside of a space to an intersection between spaces to the inside of a space alternately across the board, until it reaches another corner space termed the "Finish". The path of play turns at a right angle at each space, so that the player always exits a space on the same side he entered it, and such a path change may be symbolized by a corner symbol on the board. The path proceeds in this fashion from the "Start" to the finish, traversing all of the spaces in the player's color at least once.

The turns in the game comprise two phases for each player: jumping, and roll/move. The object of the game is to be the first to get all pieces to the "Finish".

A player may "capture" and send his opponent's pieces back to the "Start" space by either landing on the pieces with an equal or superior number of pieces, or by trapping the pieces in a special triangular arrangement of pieces on two intersections and the space between, known as a "Chebache". A secondary way of winning is to trap the opponent's "King" in a "Chebache".

DESCRIPTION OF THE PREFERRED EMBODIMENT

Figure 1:
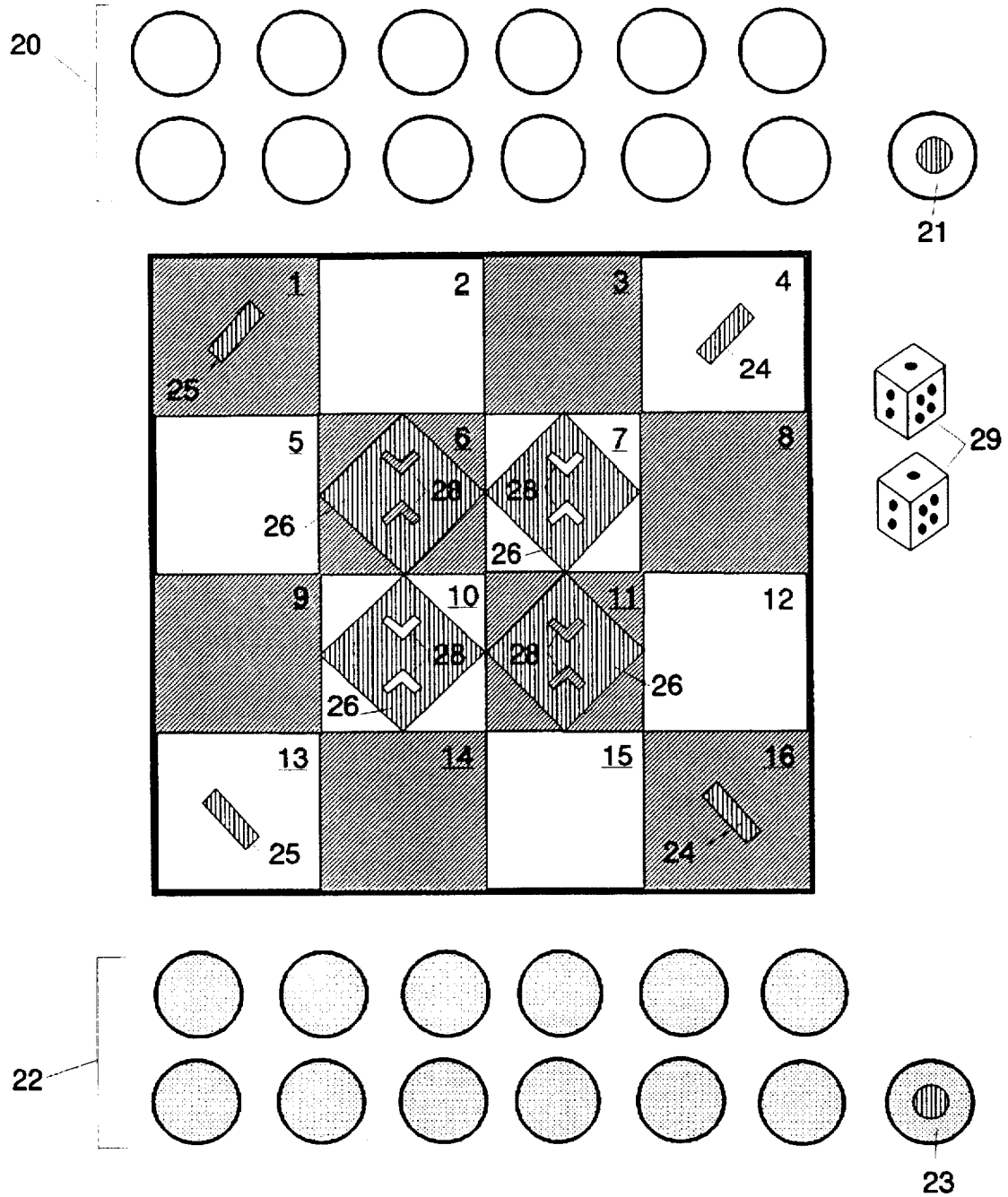
FIG. 1 shows an overview of the playing board and the playing pieces.

FIG. 1 shows the elements used to play the game of the invention. The game is played on a special playing board (to be described below), using the playing pieces or markers described in the following paragraphs. The board could be made of various materials, such as cardboard, plastic, paper, laminated wood or even marble.

A chance element is also required for determining the amount of movement, such as the conventional dice (29)

shown in FIG. 1. Alternatively, other chance elements such as special dice, tops, spinners, or electronic means could be used within the teachings of the invention.

The two players are accorded contrasting colors, preferably white and black, although any two colors could be used. For consistency in this specification, the terms "white" and "black" will be used to designate the players.

Figure 2:
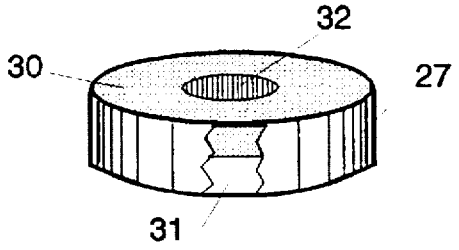
FIG. 2 shows a view of the "King" playing piece.

Each player has one set of 12 identical ordinary playing pieces of his/her color-white (20) and black (22). In the preferred embodiment, each player also has a special "King" piece (21) and (23) which is preferably bi-colored (see FIG. 2), with one side (30) black and the other (31) white, possibly with the edge colored in some contrasting color such as red (27). Some marking, such as the dot (32) shown in FIG. 2, or a crown or other marking, is preferably applied in a contrasting color to additionally distinguish the "King" from the other pieces. The player turns the "King" so that the color representing his side is uppermost, as shown in FIG. 1.

FIG. 1 shows the playing board of the preferred embodiment of the invention. It has been designed to present a simple, elegant, and esthetically pleasing configuration, without distracting markings, while providing ample clues to the direction of play. It will be understood, however, that the board could be presented differently, such as by using words in place of the simple symbols, by explicitly marking the path of travel of the pieces with arrows or lines, or by eliminating the symbols entirely, within the teachings of the invention.

The preferred playing board has 16 rectangular or square spaces of two colors (1)–(16), arranged in a 4×4 array of orthogonal rows and columns in two alternating colors, which match the colors of the players' markers. As noted above, black and white spaces are shown, but black and red or some other combination could be used. In the preferred embodiment, the four center spaces (6)(7)(10) and (11) have special markings in a contrasting third color, shown in the figures as red diamonds (26), which indicates that these are special spaces, as detailed below.

There are four additional special spaces (1), (4), (13) and (16), in the corners of the board. Spaces (4) and (16) are the "Start" spaces for the white and black players, respectively, and are marked with a contrasting colored rectangle (24) pointing inwards to key the player as to the initial direction of travel of pieces starting there. Similarly, spaces (1) and (13) are the "Finish" spaces for the black and white players, respectively. They, too, are marked with rectangles (25) of contrasting color, arranged across the direction of travel of a piece entering the space so as to symbolize stopping. It will be understood that other designs of these space markers (24) and (25) could be used, including the words "START" and "FINISH", if desired, or these words could be printed within the rectangular markers. If desired, the "Start" and "Finish" spaces could be left unmarked, since the direction of play is simple enough.

Additional right-angle markers (28) are provided in the center squares (6)(7)(10) and (11), to provide visual clues as to the direction of travel of the pieces across the board, and to indicate that moves starting in these spaces may progress in either direction, forward or backward. Such markings are desirable since the direction of travel takes a right-angle bend in these squares, the pieces pass through these squares twice (and thus they may be considered two "spaces"), and also that the spaces in these squares are the only spaces from which an ordinary piece may move forward or backward, as will be discussed below. However, these markers could be omitted if desired.

Figure 5:
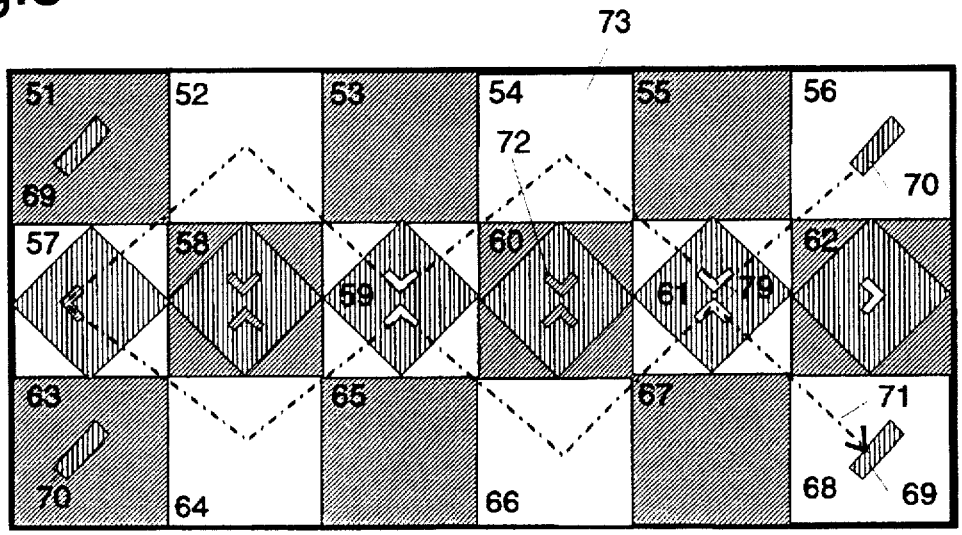
FIG. 5 shows a variation on the playing board.

FIG. 5 shows an alternative arrangement of the board, a rectangular embodiment having 18 black and white spaces in a 3×6 arrangement. As in the preferred 4×4 space arrangement shown in the other figures, the ornamental red diamonds (73) and markers (72) can be included. The "Start" and "Finish" spaces are preferably marked with symbols (69) and (70), respectively, as discussed above. The path of movement of the pieces is the same as in the 4×4 embodiment, progressing alternately from space to intersection. The path of travel in this embodiment is shown for the white pieces by dot-dash line (71).

Other arrangements of spaces are possible within the teachings of the invention, although the two arrangements shown in the figures are preferred for reasons of ease of play, length of game, etc.

Figure 3:
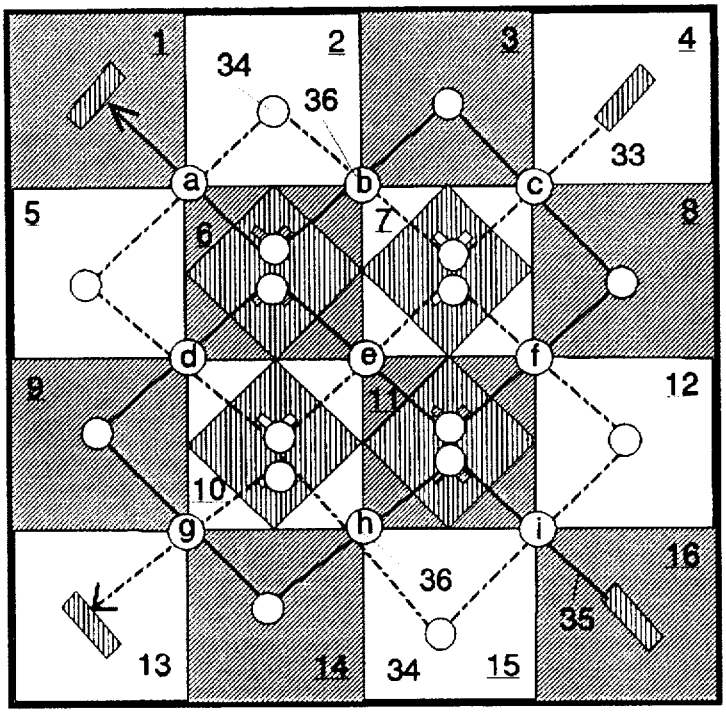
FIG. 3 shows a view of the board with the path of movement of playing pieces marked thereon.

FIG. 3 shows a board of the preferred configuration, with the preferred direction of movement of the pieces added. The direction of travel of the white pieces, from the white "Start" space (4) to the white "Finish" space (13) is marked with a dashdot line (33). Similarly, the direction of travel of the black pieces, from the black "Start" space (16) to the black "Finish" space (1) is marked with a solid line (35). It will be understood that these lines do not actually appear on the board, but are shown in this figure for example purposes.

Each piece may stop only at the circles shown, which mark "spaces" (34) or "intersections" (36), and the path proceeds from space (34) to intersection (36) to space (34) across the board as shown by lines (33) and (35). Each transition from space (34) to intersection (36) marks a single-unit move. In the following table, the numbers are space numbers, and the letters represent intersections between squares. The basic path of play from "Start" to "Finish" is as follows:

White Pieces:

Start (4)-c-7-b-2-a-5-d-10-e-7-f-12-i-15-h-10-g-Finish (13)

Black Pieces:

Start(16)-i-11-h-14-g-9-d-6-e-11-f-8-c-3-b-6-a-Finish (1)

Note: Moves starting on bold numbered spaces 6, 7, 10 and 11 may proceed either forward or backward. All other moves must be in the forward direction only.

In an alternate embodiment, the game could be played without a predefined path of travel, simply requiring the pieces to be moved from space to intersection to space, optionally with the requirement that the two intersections must be on the same side of the space. This would make the game more free-form, like checkers or chess, but somewhat longer and harder to play.

The object of the game is to be the first player to move all 13 pieces to the "Finish" space, or to trap the opponent's "King" piece in a "Chebache" (as described below).

SETUP AND STARTING THE GAME

One player takes the white and the other the black pieces including a "King" piece which (if bi-colored) is turned to match the rest of the player's pieces. The board is placed between the players so that the "Start" space (90) and (91) for white and black, respectively, is on the side of the board closest to the player of that color.

Figure 6:
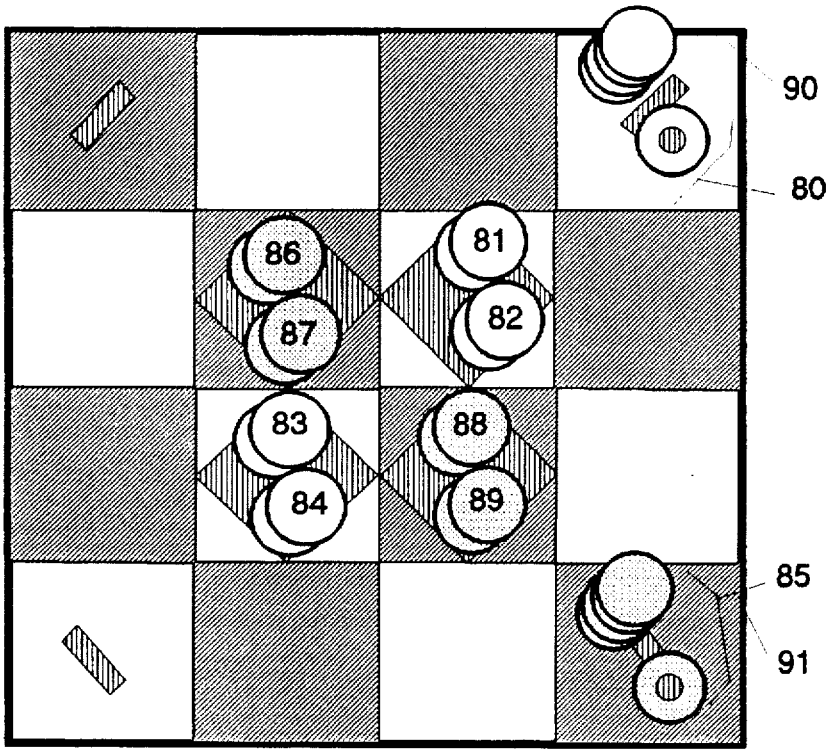
FIG. 6 shows how the playing pieces are arranged on the board at the beginning of play.

FIG. 6 shows a playing board with the pieces properly set up to start the game, according to the preferred embodiment. It is also possible to start the game with all pieces in "Start", or all pieces off the board entirely, as might be desired.

The playing pieces are preferably placed on the board in the following manner:

1. Two pieces are placed on each of the four angle marks within the red diamonds on the center-most spaces, with the pairs of pieces being placed on the spaces which correspond to the color of the pieces. In FIG. 6 this is shown as white pairs (81)–(84) on the white center spaces, and black pairs (86)–(89) on the black center spaces.

2. Four pieces and the "King" piece are placed in the "Start" space corresponding to the color of the pieces. In FIG. 6, the white stack (80) is in white "Start" space (90), and black stack (85) is in black "Start" space (91).

Play starts with each player rolling one die. The player with the highest roll starts play using the starting roll of both players' dice to move the first one or two pieces, according to the rules for movement (below). Play continues with opponent rolling the dice and moving. Thereafter, the standard sequence of play described in the following section(s) is followed.

SEQUENCE OF PLAY

Each player moves in turn, with each turn having two phases, in the following order:

(a) the player may "jump", if possible (see below for jumping rules).

(b) the player rolls the dice and moves pieces according to the roll/movement rules (see below).

After the player jumps (if possible) and moves, the play passes to the opponent.

"JUMPING"

Figure 7:
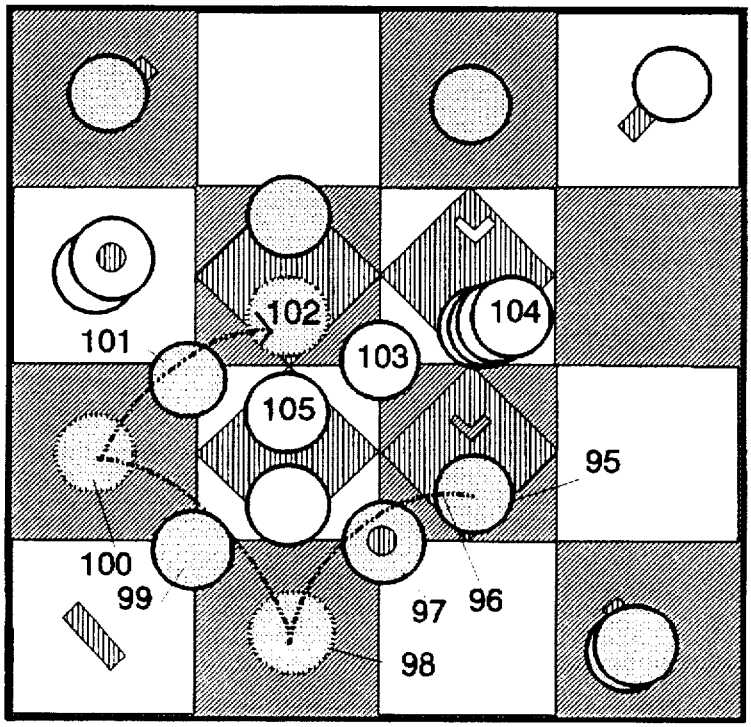
FIG. 7 shows a "jump" move on a playing board.

FIG. 7 shows a jump move. Before rolling the dice, the player may jump a stack of up to four pieces over any series of consecutive intersections occupied by that player's own pieces, but not over any intersections which are empty or occupied by the opponent's pieces. This is shown by the movement of black piece (95) indicated by dash-dot line (96), which jumps over black pieces (97), (99) and (101) to positions (98), (100) and (102). The piece may not be jumped further, since the next intersection is occupied by a white chip (103). If any of the intervening spaces were controlled by the opponent in a "Chebache" arrangement (see step (a), above), then the player may not jump into that space.

The jump sequence must begin and end with the same piece or stack of pieces. That is, a player may not drop off or pick up pieces along a sequence of jumps.

A player may not have more than four pieces in any space on which the jumping pieces land in a jump sequence (as opposed to intersections which are jumped over). Thus, white piece (105) cannot be jumped over white piece (103), since the destination space (104) already has four pieces in it. However, if destination space (105) were empty, the four pieces from (104) could be jumped into space (105). Since jumping pieces do not occupy the intersections over which they jump, four pieces may jump over other pieces without violating the stacking limit.

A player with piece(s) in the "Finish" space who also has piece(s) in the "Start" space may NOT jump.

ROLLING and MOVEMENT

In order to move, the player rolls the dice, and moves pieces along the path shown in FIG. 3 exactly the number of spots showing on the dice. The player must move either:

a) two pieces individually, each according to the roll of one die; or b). one piece twice, each move according to the roll of one die. (As an optional rule, if it is impossible to use the roll on one of the dice, the player may decline to move the roll on that die)

That is, if the player rolled a "two" and a "six", he may either move one piece two spaces and six spaces, or may move one piece two spaces and another six spaces.

If the roll was "doubles" (i.e. the same number of spots on each die), then the number of spaces which the player may move during the movement phase is doubled. That is, if a player rolls "two-two", then the player may move any combination of four two-space moves—one piece can be moved two spaces four times, two pieces can be moved twice for two spaces each, four individual pieces can be moved two spaces each, and so on. A piece may not, as a result of a "doubles" move, end a turn on the space from which it was moved (that is, one cannot use a "doubles" to effectively make no move by moving a piece out and then back to the same space).

Although more than one piece may occupy a space or intersection (this is referred to as "stacking"), no more than four pieces may be stacked in a single space or intersection. While a piece is moving it may move through a space or intersection, even if the move would result in more than four pieces in the intermediate space or intersection, so long as the result of the move does not violate the 4-piece stacking limit rule. For the purposes of counting stacked pieces, a "King" counts as two pieces.

The ordinary pieces may normally be moved only forward along the path of play. However, if the move starts from any space which is marked by angle mark (28) and/or by the red diamond (26) (in the 4×4 preferred board, these are "center" squares (6), (7), (10) and (11)), the piece may be moved either forward or backward the full amount of the roll on one die. "Kings" may be moved either forward or backward from any square.

Two exceptions to this rule are that no piece may be moved backward into the "Start" space, and once a piece has entered "Finish" it may not be moved backward out of the space.

Unlike the spaces, the intersections are shared by the paths of play for both colors. A piece may not end its move on an intersection occupied by a piece of the opposite color, except to capture it and send it back to "Start" (see below). However, a piece may move through an intersection occupied by the other player's pieces.

Pieces on top of a "King" must be moved before the "King" can move except when a stack is jumping.

As an additional restriction, if a player has one or more pieces in the "Finish" space, that player must move any pieces which are in the "Start" space before moving any other pieces on the board.

Attacking and Capturing Pieces

A player can capture and send an opponent's piece(s) back to "Start" in one of two ways:

a) "Attack" by landing on a piece or stack of pieces with an equal or greater number of pieces (a "King" counts as two pieces), except that a "King" may not attack a "King" under any circumstances; or b) Trapping a piece or a stack of pieces in a "Chebache" situation described below. If the opponent is able to trap the "King" in a "Chebache", and the player is unable to save the "King" from the "Chebache", then the attacking player WINS the game.

If an ordinary piece is captured, it is sent back to the player's "Start" space. When a "King" piece is captured, it is flipped to the opponent's color so that the opponent controls the King, and the "King" is placed on top of the stack. If the result of an attack is that a player has more than four pieces in an intersection (with the "King" counting as two pieces), any excess pieces are sent back to the appropriate player's "Start" space.

The "Chebache" Situation

Figure 4:
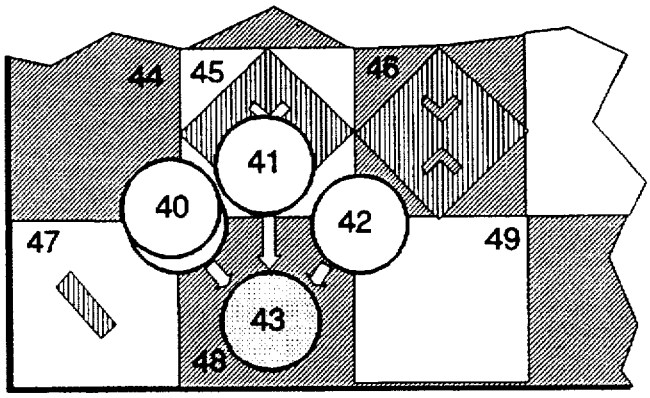
FIG. 4 shows a detail of part of a playing board, showing the arrangement of playing pieces known as a "Chebache".

When a player occupies two consecutive intersections and the space between them it is called a "Chebache", and the space toward which the "Chebache" opens is called "threatened". As shown in FIG. 4, the white pieces—at (40), (41) and (42) create a "Chebache" arrangement, threatening the black piece (43) in the space (48) toward which the angle formed by the three pieces opens. This angle may open either way—if the pieces at (40) and (42) were black, then the white piece (41) on space (45) would be threatened by the "Chebache". Although a stack of two pieces is shown at (40) for the purpose of illustration, it will be understood that only one piece on each intersection and space is required to create the "Chebache" and threaten the space toward which it points.

Figure 8:
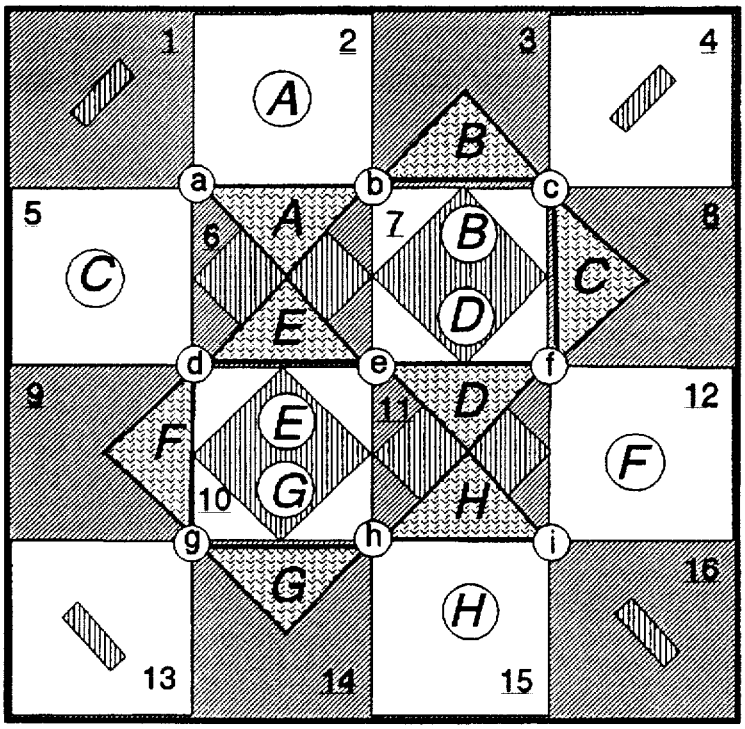
FIG. 8 shows a playing board with the "Chebache"arrangements for the black player indicated.

FIG. 8 shows the possible "Chebaches" for the black player, with the spaces which are threatened by each "Chebache" indicated by a lettered triangle (A) through (H) showing the two intersections and the space creating the arrangement. The corresponding lettered circle shows the space threatened by the "Chebache". It will be understood that the white player would have corresponding number of "Chebache" options.

In addition to the adjacent-space "Chebache" described above, there is an additional situation which can create a "Chebache". The end spaces of the two "inner horizontal" rows: black spaces (8) and (9) and white spaces (5) and (12) are threatened by "Chebaches" directly across the board. That is, Chebache (F) at (f)-(12)-(i) threatens space (9), on the opposite side of the board. Similarly, "Chebache" (C) at (c)-(8)-(f) threatens space (5). On the white player's side, the Chebache at (a)-(5)-(d) threatens space (8) and the "Chebache" at (d)-(9)-(g) threatens space (12).

Optionally, "Chebache" (C) made up of pieces on space (8) and intersections (c) and (f) would not threaten any squares, since there is no piece possible on that side of the center space (7) (in another option, this situation could be considered to threaten both possible pieces in the center square, but this is not preferred). Similarly, in this option, spaces (5), (8), (9) and (12) cannot be threatened by "Chebache".

Players can have more than one Chebache arrangement on the board at any given time. No player may land a piece or stack of pieces in a space controlled by a Chebache—not even as an intermediate space on a sequence of jumps—although a player may move through a threatened space during a move.

Once a Chebache is established, the player says "CHEBACHE!" This warns the opponent that all pieces that are in the space that the Chebache angle "threatens" are in danger of being sent back to "Start".

There are two ways to avoid losing pieces threatened by a Chebache:

(1) "break" the Chebache by "capturing" and sending the piece(s) occupying at least one of the intersections creating the Chebache back to "Start", in accordance with the rules below; or (2) "escape" the Chebache by moving the threatened piece (s) out of the threatened space, if such a move is possible.

Note: A player may choose to lose the pieces threatened by a Chebache (termed a "sacrifice", if a better move elsewhere is preferred.

In the example in FIG. 4, the black player could escape the Chebache by moving piece (43) along the path of play to square (44) or beyond. Assuming there are no other black pieces which can be landed on space (40), the black player could not break the Chebache by capture—since there are two white pieces at (40) they cannot be captured by the single piece at (43), and since the black piece (43) can only be moved forward, it cannot capture the other single piece (42).

SPECIAL END-GAME OPTIONAL RULES

If all of a player's pieces are close to the finish, a situation can arise where a player cannot use the roll of the dice except by oscillating backward and forward to use up the roll without advancing the play of the game. To bring the game to a more exciting end game, there are a number of optional rules which may be implemented, either singly or in combination. In the preferred embodiment, all three optional end-game rules are played. All of these optional rules apply only if all a player's pieces are within six spaces of "Finish":

Optional End-game Rule 1:

An exact roll is no longer needed to move into "finish". That is, if a piece is four spaces from "Finish" and the player rolls "five", it may be moved into "Finish", even though an exact roll of four is normally required.

Optional End-game Rule 2:

The pieces which are farthest from "Finish" must be moved first, assuming that the roll is greater than the distance between "Finish" and the farthest piece from "Finish".

Optional End-game Rule 3:

The player may choose not to move, rather than to move backward.

ADDITIONAL OPTIONAL RULES a) For a shorter game, the game may be played without the "King" pieces.

b) All pieces could be made as the "King", in a bi-color form. In this variation, a "captured" piece is flipped to the player's color, similar to the game of "Reversi"(or "Othello®"). An additional "Win" situation then becomes the acquisition of all of the opponent's pieces.

c) Intersections can be "controlled" by landing a single piece on top of whatever pieces are there, in which case all of the pieces on the intersection are controlled by the player playing the color of the top piece, and lower pieces are trapped in place.

d) Although described in terms of a board game with physical dice and pieces, it will be understood that the subject game may also be simulated using a programmed computer.

e) As noted above, the game could be played with no defined path for the pieces, other than to require them to move from space to intersection to space, with or without the requirement that the pieces leave a space through an intersection on the same side as that through which they entered (i.e. prohibiting moves diagonally through a space).

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A board game for two players comprising:

a) a flat, generally rectangular playing board comprising i) a series of adjacent orthogonal rows and columns, each of which are comprised of a plurality of contiguous individual spaces, ii) each space having an inside and four corners, the corners between adjacent spaces being termed "intersections", iii) the spaces being colored alternately in a first or a second color such that adjoining spaces are of contrasting colors, b) a plurality of playing pieces, there being an equal quantity of playing pieces of each of the first and second colors;

c) a chance element for selecting a random number for determining movement of pieces;

d) the movement of the pieces being determined at least in part in accordance with the random number selected by the chance element, the movement being from space to intersection to space alternately;

e) the pieces of one color at an intersection being "captured" if pieces of the opposing color are moved onto the intersection;

f) if pieces of a single color occupy two intersections and the space between, the space of the opposing color sharing the two intersections is referred to as "threatened";

g) the pieces are required to move in a predefined direction along a defined path, the direction depending upon the space from which the move starts;

h) the pieces may move in either direction along the defined path on moves which start from at least one predefined space; and i) the spaces from which the pieces may be moved in either direction are marked with a distinctive marking.

2. The board game of claim 1, further comprising:

a) one space of each color being designated as the "start" space for the player having the color of that color, b) one space of each color being designated as the "finish" space for the player having the color of that color, c) whereby a "win" occurs when a player has moved all pieces of a color to the "finish" space of the player's color.

3. The board game of claim 2, further comprising a defined path leading from the "Start" space for each player to the "Finish" space for the player, traversing each of the spaces on the board having the player's color at least once, the defined path leading alternately from the inside of spaces to intersections.

4. The board game of claim 3, in which the defined path is defined so as to enter and leave spaces by passing through intersections which are on the same side of the space.

5. The board game of claim 2 in which, at the beginning of the game, all of the pieces are located in the "start" space of the same color as the pieces.

6. The board game of claim 2 in which, at the beginning of the game, less than all of the pieces are located in the "start" space of the same color as the pieces.

7. The board game of claim 2, in which at least one of the spaces other than the "start" and "finish" spaces is provided with a marking indicating the direction of travel through the space.

8. The board game of claim 2, in which a "captured" piece is sent back to the "start" space of the same color.

9. The board game of claim 1, in which a piece located in a threatened space is "captured" if it is unable to move out of the threatened space.

10. The board game of claim 1, in which the marking is a right-angle mark.

11. The board game of claim 1 in which there are twelve playing pieces of each color.

12. The board game of claim 1 further comprising at least two "king" pieces.

13. The board game of claim 12 in which the "king" piece counts as two pieces for the purpose of determining the number of pieces in a space or intersection.

14. The board game of claim 12 in which a "win" occurs when the "king" piece is located in a threatened space, and is unable to be moved from the threatened space.

15. The board game of claim 12 in which each "king" piece has two sides, each side being of one of the two colors, such that the "king" piece may be inverted to convert from one color to the other, and if a "king" piece is "captured", the "king" piece is inverted, such that the "king" piece becomes the color of the moving player.

16. The board game of claim 1 in which the pieces may be moved directly from a space to another space without reference to the chance element, so long as the intersection between the spaces is occupied by at least one piece of the same color.

17. The board game of claim 1 in which the chance element is at least one die.

18. The board game of claim 17 in which the chance element is two dice.

19. The board game of claim 18 in which at least one of the pieces is moved the sum of the random numbers selected by the two dice.

20. The board game of claim 18 in which one of the pieces is moved the random number selected by one of the two dice, and another piece is moved the random number selected by the other one of the two dice.

21. The board game of claim 18 in which, if the roll of both dice are the same, the total number of moves is doubled.

22. The board game of claim 1, in which there are four rows and four columns.

23. The board game of claim 1, in which there are three rows and six columns.

24. The board game of claim 1, in which each piece has two sides, each side being of one of the two colors, such that the piece may be inverted to convert from one color to the other, and if a piece is "captured", the piece is inverted, such that the piece becomes the color of the capturing player.

25. The board game of claim 1, in which a piece located in an intersection may be captured by moving an equal or greater number of opposing colored pieces onto the intersection.

26. The board game of claim 1, in which no more than a predefined number of pieces may occupy a space or intersection.

27. The board game of claim 26, in which the predetermined number is four.

* * * * *